United States Patent [19]

Remmers

[11] Patent Number: 4,732,284

[45] Date of Patent: Mar. 22, 1988

[54] FREE STANDING STACKING SHELF SYSTEM

[75] Inventor: Lee Remmers, Ocala, Fla.

[73] Assignee: Clairson Corporation, Ocala, Fla.

[21] Appl. No.: 929,776

[22] Filed: Nov. 13, 1986

[51] Int. Cl.[4] ..... A47B 47/00

[52] U.S. Cl. ..... 211/188; 211/181; 211/194; 108/91

[58] Field of Search ..... 211/188, 181, 134, 194, 211/153; 248/188.1; 108/91

[56] References Cited

U.S. PATENT DOCUMENTS

| | | | |
|---|---|---|---|
| 2,844,262 | 7/1958 | James | 211/188 |
| 2,850,172 | 9/1958 | Beckner | 211/181 X |
| 3,013,670 | 12/1961 | Mayer | 211/181 X |
| 3,289,614 | 12/1966 | Frazier | 108/91 |
| 4,444,320 | 4/1984 | Chap | 211/194 X |
| 4,603,781 | 8/1986 | Ryan, Jr. | 211/153 X |

*Primary Examiner*—Ramon S. Britts

*Assistant Examiner*—Blair M. Johnson

*Attorney, Agent, or Firm*—Cushman, Darby & Cushman

[57] ABSTRACT

A free-standing stacking shelf system is disclosed which includes at least two shelves, each of the shelves being provided with at least two stacking elements which are removably coupled thereto and extend downwardly therefrom. Each of the stacking elements is substantially U-shaped having first and second arms and a base extending therebetween. The arm members are removably coupled at the ends thereof to a respective shelf and include means for preventing relative vertical movement of the shelf and the stacking element coupled thereto. Each of the stacking elements also includes indented portions for engaging a next lower shelf so that the stacking element maintains adjacent shelves in vertically spaced relation. The stacking elements also preferably include a horizontally extending bar element on at least one arm thereof so as to maintain the stacking element and the shelf in a predetermined angular orientation.

20 Claims, 5 Drawing Figures

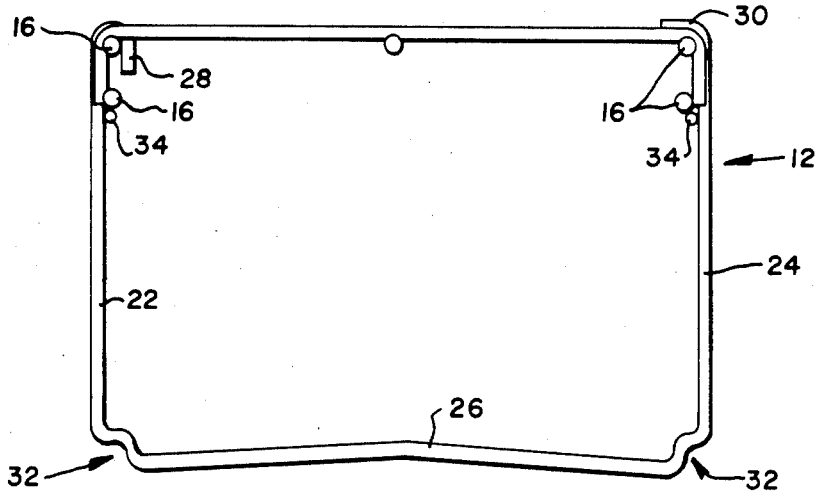
Fig. 2
Fig. 3
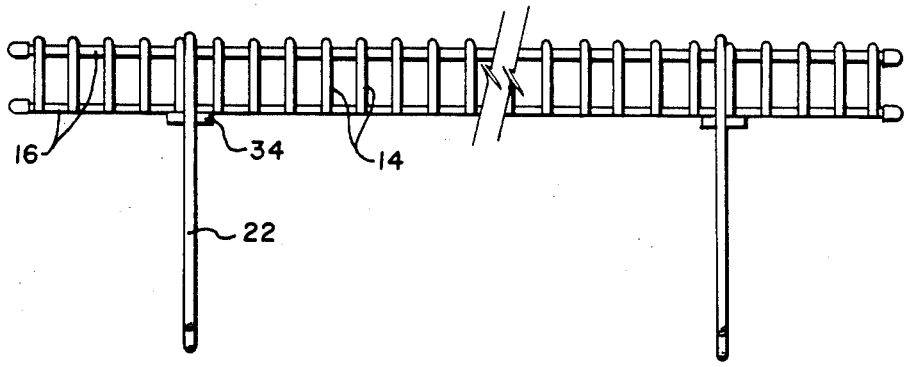
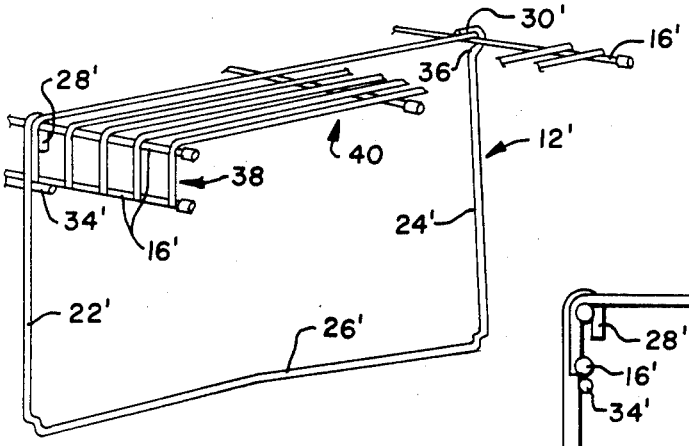
Fig. 4
Fig. 5
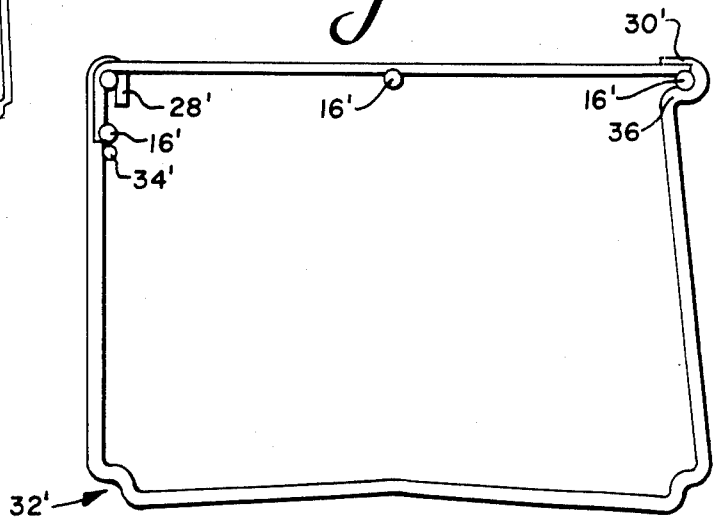

FREE STANDING STACKING SHELF SYSTEM

BACKGROUND OF THE INVENTION

The present invention relates to shelving systems and more particularly to a free standing stacking shelf system.

Shelving systems are known that include a plurality of shelves, each shelf being formed from a plurality of parallel bars which are fixedly coupled together at spaced intervals from each other by longitudinally extending bars. When these shelving systems are assembled, each of the shelves are mounted to a wall at vertically spaced intervals and/or are fixedly coupled at vertically spaced intervals to a vertical pole. These shelving systems have the disadvantage that they are not free standing. Furthermore, such shelving systems may not be readily disassembled for moving the same and/or readily assembled so as to provide a different number of shelves in accordance with a consumer's varying needs.

Accordingly, it would be desirable to provide means for stacking shelves of the aforementioned type so that different numbers of shelves may be provided in the shelving system, so that the shelving system is free standing, and so that the shelving system may be quickly and easily disassembled and reassembled.

The shelving system of the present invention overcomes the aforementioned problems by providing a means whereby shelves may be stacked in a free standing manner, different numbers of shelves may be provided in accordance with a consumer's particular needs, and the system may be readily assembled and disassembled as desired. In particular, the free standing stacking shelf system of the present invention includes stacking elements which are removably coupled to and extend downwardly from shelves of the shelving system and removably engage a next lower shelf so as to hold the shelves in a free standing spaced relation.

Other objects, features, and characteristics of the present invention, as well as the method of assembling and functions of the related elements of the structure, and the combination of parts and economies of manufacture, will become more apparent upon consideration of the following description and appended claims with reference to the accompanying drawings, all of which form a part of the specification, wherein like reference numerals designate corresponding parts in the various figures.

BRIEF DESCRIPTION OF THE DRAWINGS

FIG. 2 is a side plan view of a stacking shelf of the embodiment FIG. 1;

FIG. 3 is a front plan view partly broken away of a stacking shelf of the embodiment of FIG. 1;

FIG. 4 is an elevated plan view partly broken away of a second embodiment of a stacking shelf in accordance with the present invention; and FIG. 5 is a side plan view of the stacking shelf of FIG. 4.

Figure 1:
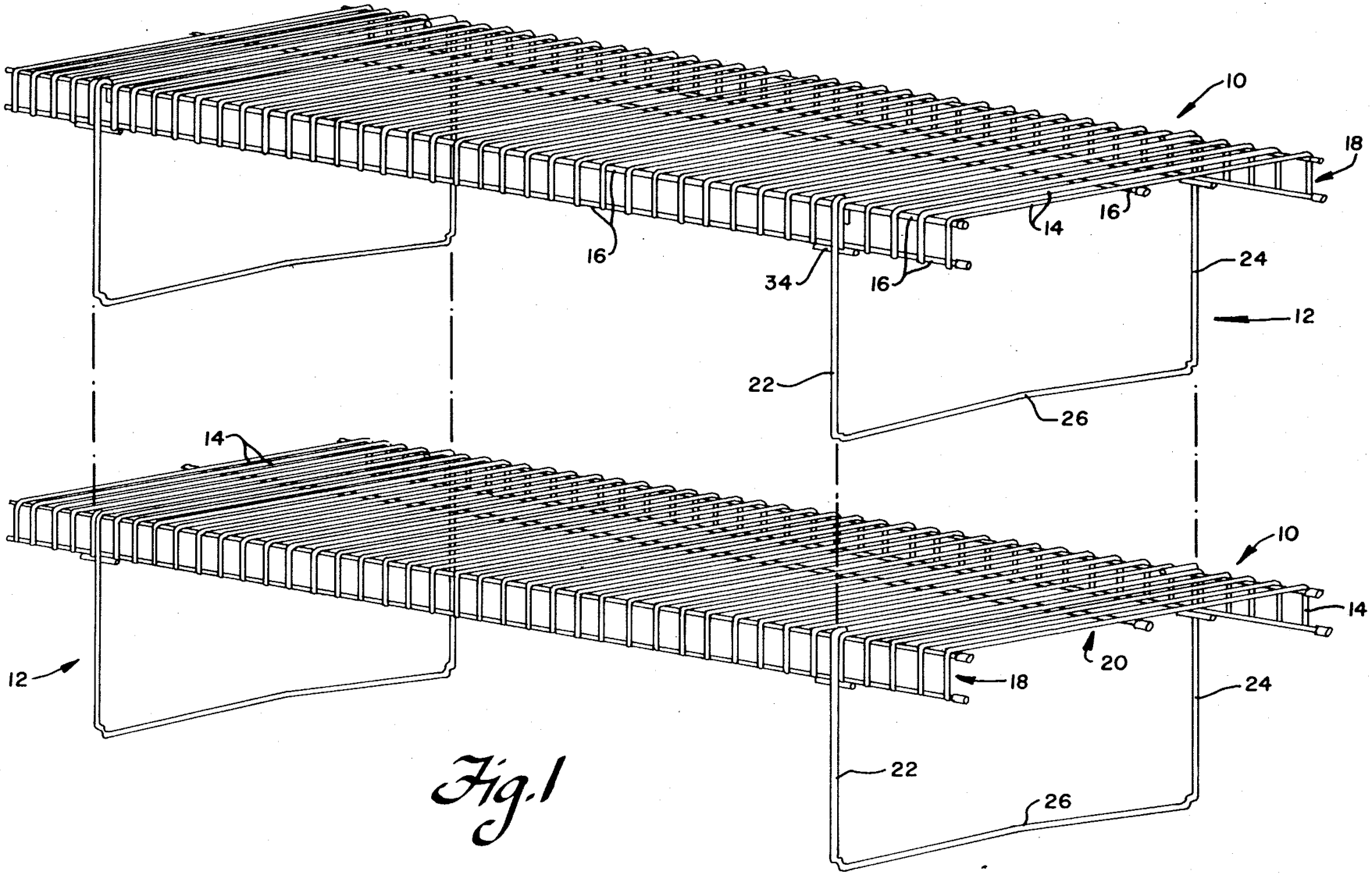
FIG. 1 is an exploded plan view of a free standing stacking shelf system in accordance with one embodiment of the present invention.

DETAILED DETAILED DESCRIPTION OF THE PRESENTLY PREFERRED EXEMPLARY EMBODIMENTS OF THE PRESENT INVENTION

Referring to FIG. 1, one manner in which a first embodiment of the free standing stacking shelf system of the present invention may be assembled is shown. As can be seen, the shelving system includes at least two shelf members 10 each of which are removably coupled to at least two stacking elements 12. The shelf members 10 of this embodiment are of the type including a number of crosswise bar members 14 which are coupled together in parallel spaced relation by longitudinally extending bar members 16. As can be further seen in FIG. 1, the bar members 14 forming the shelf member 10 are disposed so as to have downwardly extending ends 18 and horizontal portions 20 so that the shelf member 10 has a generally inverted U-shape, the longitudinal bar members 16 being disposed at least at the corners and ends of the U-shaped shelf 10.

Referring to FIGS. 1 and 2, one embodiment of a stacking element formed in accordance with the present invention is shown. This stacking element 12 includes first and second arm members 22 and 24, respectively and a base member 26 coupled to and disposed between the first and second arm members 22 and 24. Each stacking element 12 further includes means for removably coupling the same to a shelf 10. In the illustrated embodiment the means for removably coupling include a J-shaped hook element 28 provided on the end of the first arm 22 and an L-shaped hook element 30 provided On the end of the second arm member 24. As can be further seen in FIGS. 1 and 2, when a stacking element 12 is coupled to a shelf member 10, hook element 28 and hook element 30 each engage a respective longitudinal bar 16 provided at a corner of the shelf member 10. Therefore, it is to be understood that any shaped hooking element which can firmly engage a longitudinally extending bar member 16 may be provided to removably couple a stacking element 12 to a shelf member 10.

Each of the stacking elements 12 is further provided with means for engaging a next adjacent lower shelf. In the illustrated embodiment, the means for engaging include indented portions 32 provided at the lowermost portion of each of the arm members 22 and 24, adjacent the base member 26. Each of the indents 32 is sized so as to engage and rest upon a horizontal bar member 16 provided at the corners of a next adjacent shelf 10 as can be seen by the dash dot lines in FIG. 1.

Referring to FIGS. 1 and 3, in particular, it can be seen that first and second arm members 22 and 24 are further provided with means which prevent relative vertical movement of a stacking element 12 and the shelf member 10 to which it is attached. In the embodiment illustrated in FIGS. 1 and 3, the means for preventing relative movement comprise bar elements 34. The bar elements 34 are disposed on the first and second arm members 22 and 24 and perpendicular thereto so as to be parallel to the longitudinally extending bar members 16 provided on the shelf member 10. As can be seen, the bar elements 34 are spaced from the upper end of each arm member 22 and 24 so as to be disposed immediately below a lowermost longitudinally extending bar member 16 on the U-shaped shelf member 10. In this manner, the bar elements 34 will engage and support the aforementioned longitudinal bar members 16 and will prevent the shelf member 10 from moving downwardly relative to the stacking element 12 when the stacking element 12 has been coupled to the shelf member 10. The bar elements 34 also provide a means for maintaining the stacking element 12 in a predetermined angular orientation relative to its respective shelf member 10. As is apparent, the angular orientation is maintained by the bar element 34 because the bar element 34 is disposed parallel to and along a portion of the length of its respective longitudinal bar member 16.

Referring to FIGS. 4 and 5, a second embodiment of the free-standing stacking shelf system of the present invention is shown. In this embodiment, the shelf member 10' includes a number of crosswise bar members 14' and a number of longitudinally extending bar members 16' which are coupled to the crosswise bar members 14' and retain the same in a parallel, spaced relation. The shelf member 10' differs from the shelf member 10 in that the bar members 14' include a single downwardly extending portion so as to form a shelf member 10' having a generally L-shape with a downwardly extending portion 38 and a horizontal portion 40. Further, the longitudinal bar members 16' are disposed at least at the corner and ends of the L-shaped shelf 10'.

As can be further seen in FIGS. 4 and 5, the stacking element 12' of this embodiment includes first and second arm members 22' and 24' and a base member 26' coupled to the lowermost portion of arm members 22' and 24' and extending therebetween. The arm member 22' includes a J-shaped hook element 28' which is adapted to engage the longitudinally extending bar member 16' provided at the corner of the shelf 10' and a bar element 34' which is adapted to be disposed immediately below and parallel to the longitudinally extending bar member 16' provided at the end of the downwardly extending portion 38 of shelf member 10' so as to maintain the shelf 10' and the stacking element 12' in a predetermined angular orientation. Furthermore, arm member 24' includes a generally L-shaped hook element 30' which is adapted to engage the longitudinally extending bar member 16' provided at the end of the horizontal portion 40 of the shelf 10'. The stacking element 12' differs from the stacking element 12 in that the means for preventing relative vertical movement of the arm member 24' and the shelf member 10' comprises an inwardly extending portion 36 of arm member 24'. The inwardly extending portion 36 is adapted to underlie the longitudinally extending bar member 16' provided at the end of horizontal portion 40 of shelf member 10'.

As is clear from the discussion above, the stacking elements of the present invention enable shelves of the types disclosed to be stacked in a free standing manner, enable different numbers of shelves to be provided in accordance with a consumer's needs and the system may be readily assembled and disassembled as desired. Furthermore, using the stacking elements formed in accordance with the present invention, different shelves may be stacked atop one another in a single shelving system. For example, one or more U-shaped shelves 10 with stacking elements 12 coupled thereto may be stacked on one or more L-shaped shelves 10' with stacking elements 12' coupled thereto and vice versa so that a plurality of shelving systems may be formed in accordance with the needs and tastes of the consumer.

As is also apparent from the foregoing, the shelf members and stacking elements of the present invention may be formed of any suitable material including, but not limited to, wood, metal, or plastic. However, in the preferred embodiments, the bar members of the shelf member as well as the stacking elements are formed from metal rods that are coated so as to be protected from scratching and so as to be aesthetically pleasing. The coating provided on the metal rods may be, for example, a polymeric coating. Furthermore, the coating may be pigmented so as to be aesthetically pleasing and to suit the particular tastes of the consumer.

While the invention has been described in connection with what is presently considered to be the most practical and preferred embodiments, it is to be understood that the invention is not to be limited to the disclosed embodiment, but on the contrary, it is intended to cover various modifications and equivalent arrangements included within the spirit and scope of the appended claims.

What is claimed is:

1. A free-standing stacking shelf system comprising:

at least two shelf members;

at least two stacking elements removably coupled to each of said at least two shelf members and extending downwardly therefrom, each of said stacking elements being substantially U-shaped, having first and second upwardly extending arm members and a base member coupled to and disposed between a lowermost portion of said first and second arm members, at least one of said arm members including means for removably coupling the stacking element to the shelf member comprising a generally hooked-shaped uppermost end portion of said arm member, at least one of said arm members including means for maintaining said stacking element and said shelf member in a predetermined angular orientation, each of said arm members including means for preventing relative vertical movement between the stacking element and the shelf to which it is attached, and each of said arm members further including means at said lowermost portion thereof for engaging a next adjacent shelf member.

2. A free-standing stacking shelf as claimed in claim 1, wherein each said shelf member comprises a plurality of crosswise bar members and a plurality of longitudinal extending bar members coupled to each said crosswise bar member and maintaining the same in a parallel, spaced relation, each said crosswise bar member having a substantially inverted U-shape so as to form an inverted U-shaped shelf member, said longitudinal bar members being provided at least at the corners and the ends of said U-shaped shelf member.

3. A free-standing stacking shelf as claimed in claim 2, wherein said means for removably coupling comprises a J-shaped hook formed at the end of said at least one arm member.

4. A free-standing stacking shelf as claimed in claim 2, wherein said means for removably coupling comprises an L-shaped hook formed at the end of said at least one arm member.

5. A free-standing stacking shelf as claimed in claim 3, wherein said means for maintaining comprises a horizontal bar element coupled to said at least one arm so as to underlie said longitudinally extending bar members provided along said ends of said U-shaped shelf member when the stacking element is removably coupled to said shelf member.

6. A free-standing stacking shelf as claimed in claim 4, wherein said means for maintaining comprises a horizontal bar element coupled to said at least one arm so as to underlie said longitudinally extending bar members provided along said ends of said U-shaped shelf member when the stacking element is removably coupled to said shelf member.

7. A free-standing stacking shelf as claimed in claim 2, wherein both said arm members include means for removably coupling the stacking element to the shelf member.

8. A free-standing stacking shelf as claimed in claim 7, wherein said first upwardly extending arm member includes a J-shaped hook for removably coupling the stacking element to the longitudinally extending bar member provided at one of the corners of said U-shaped shelf member and said second upwardly extending arm member includes an L-shaped hook element for engaging the longitudinally extending bar member provided at the other corner of said U-shaped shelf member.

9. A free-standing stacking shelf as claimed in claim 8, wherein said means for maintaining comprises a horizontal bar element provided on each of said first and second arm members so as to be disposed, respectively, immediately below said longitudinal bar member provided at each end of said U-shaped shelf member.

10. A free-standing stacking shelf as claimed in claim 2, wherein said means for engaging a next adjacent shelf member comprises first and second indented portions formed at said lowermost portions of said first and second arm members, respectively, said first and second indented portions being sized so as to engage and rest on first and second longitudinally extending bar members, respectively, of a next adjacent shelf.

11. A free-standing stacking shelf as claimed in claim 1, wherein each said shelf member comprises a plurality of crosswise bar members and at least three longitudinally extending bar members coupled to said crosswise bar members and maintaining the same in a parallel, spaced relation, each said crosswise bar member being substantially L-shaped with a downwardly extending portion and a horizontal portion so as to form an L-shaped shelf member, said longitudinal bar members being provided at least at the corner and the ends of said L-shaped shelf member.

12. A free-standing stacking shelf as claimed in claim 11, wherein said means for removably coupling comprises a J-shaped hook formed at the end of said first arm member for removably coupling the stacking element to said longitudinal bar member provided at said corner of said L-shaped shelf member and an L-shaped hook element provided at the end of said second upwardly extending arm member for removably coupling the stacking element to the longitudinal bar member provided at the end of said horizontal portion of said L-shaped shelf member.

13. A free-standing stacking shelf as claimed in claim 12, wherein said means for preventing relative vertical movement comprises a bar element provided on said first arm member so as to be disposed immediately below and parallel to said longitudinally extending bar member provided on the end of said downwardly extending portion of said L-shaped shelf member and an inwardly extending portion of said second arm member which extends immediately below the longitudinal bar member to which said L-shaped hook element is removably coupled.

14. A free-standing stacking shelf as claimed in claim 11, wherein said means for engaging a next adjacent shelf member comprises first and second indents formed that said lowermost portion of said first and second arm members, respectively, said first and second indents being adapted to engage and rest on first and second longitudinally extending bar members, respectively, of a next adjacent shelf member.

15. A stacking element for a free-standing stacking shelf comprising first and second upwardly extending arm members and a base member coupled to and disposed between a lowermost portion of said first and second arm members, at least one of said arm members including means for removably coupling the stacking element to a shelf member comprising a generally hook-shaped uppermost end portion of said arm member, at least one of said arm members including means for maintaining the stacking element and the shelf member in a predetermined angular orientation, each of said arm members including means for preventing relative vertical movement between the stacking element and the shelf member, and each of said arm members further including means at said lowermost portion thereof for engaging a next adjacent shelf member.

16. A stacking element as claimed in claim 15, wherein said means for removably coupling comprises a J-shaped hook formed at the end of said at least one arm member, said means for preventing relative vertical movement comprises a horizontal bar element coupled to each said arm member, and said means for engaging a next adjacent shelf member comprises first and second indents formed at said lowermost portions of said first and second arm members, respectively.

17. A stacking element as claimed in claim 15, wherein said means for removably coupling comprises an L-shaped hook element provided at the end of said at least one arm member, said means for preventing relative vertical movement comprises a horizontal bar element coupled to said at least one arm member, and said means for engaging a next adjacent shelf member comprises first and second indents formed at said lowermost portions of said first and second arm members, respectively.

18. A stacking element as claimed in claim 15, wherein said means for removably coupling comprises a L-shaped hook element formed at the end of said second arm member and said means for preventing relative vertical movement comprises an indented portion defined along said second arm member and extending toward said first arm member.

19. A shacking element as claimed in claim 18, wherein said means for maintaining said predetermined angular orientation comprises a horizontal bar element disposed on said first arm member so as to engage a longitudinally extending portion of a shelf member.

20. A stacking element as claimed in claim 19, wherein said means for removably coupling further comprises a J-shaped hook element formed at the end of said first arm member and said means for engaging a next adjacent shelf member comprises first and second indents formed at said lowermost portions of said first and second arm members, respectively, for engaging and resting on a first and a second longitudinally extending bar member, respectively, of a next adjacent shelf member.

* * * * *